US008485780B2

(12) United States Patent
Vedsted

(10) Patent No.: US 8,485,780 B2
(45) Date of Patent: Jul. 16, 2013

(54) PUMP ASSEMBLY AS WELL AS METHOD FOR THE MODULAR CONSTRUCTION OF A PUMP ASSEMBLY

(75) Inventor: Per Frost Vedsted, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 884 days.

(21) Appl. No.: 12/500,241

(22) Filed: Jul. 9, 2009

(65) Prior Publication Data

US 2010/0008796 A1 Jan. 14, 2010

(30) Foreign Application Priority Data

Jul. 10, 2008 (EP) ..... 08012462

(51) Int. Cl.
*F04D 29/52* (2006.01)

(52) U.S. Cl.
USPC ..... 415/214.1; 417/360; 417/423.5

(58) Field of Classification Search
USPC ..... 415/213.1, 214.1, 199.1, 199.2, 199.3; 416/244 R; 29/888.02, 888.021, 525.01; 417/247, 360, 423.5
See application file for complete search history.

(56) References Cited

U.S. PATENT DOCUMENTS

| | | | | |
|---|---|---|---|---|
| 3,375,789 | A * | 4/1968 | Easton | 415/199.3 |
| 5,722,812 | A * | 3/1998 | Knox et al. | 415/199.1 |
| 6,082,960 | A * | 7/2000 | Fandrey et al. | 415/55.1 |
| 2006/0250754 | A1 * | 11/2006 | Schlosser | 361/600 |
| 2008/0085185 | A1 * | 4/2008 | Towsley et al. | 415/198.1 |
| 2011/0085904 | A1 * | 4/2011 | Gossmann | 415/214.1 |

FOREIGN PATENT DOCUMENTS

| | | | |
|---|---|---|---|
| DE | 744795 | C | 1/1944 |
| DE | 1 072 100 | B | 12/1959 |
| DE | 7407016 | U | 12/1974 |
| EP | 0 492 606 | A3 | 7/1992 |
| WO | 2006/008843 | A1 | 1/2006 |

* cited by examiner

*Primary Examiner* — Nathaniel Wiehe
*Assistant Examiner* — Joshua R Beebe
(74) *Attorney, Agent, or Firm* — Panitch Schwarze Belisario & Nadel LLP

(57) ABSTRACT

A pump assembly is provided with a pump (6) having one or more pump stages (10), wherein at least one of the components (12, 14) of the pump assembly, whose axial length depends on the number of pump stages (10). On at least one of its axial ends, the component has no connection configuration which is formed in the component (12, 14) itself and which is limited to the axial end. Instead, it is connected at this axial end with a friction fit and/or a positive fit to a connection element (20) which is coupled and/or connected to adjacent parts of the pump assembly, or is provided for coupling to adjacent parts of the pump assembly.

12 Claims, 9 Drawing Sheets

PUMP ASSEMBLY AS WELL AS METHOD FOR THE MODULAR CONSTRUCTION OF A PUMP ASSEMBLY

BACKGROUND OF THE INVENTION

The invention relates to a pump assembly, as well as to a method for the modular construction of a pump assembly.

Pump assemblies, in particular multi-stage pump assemblies are known, with which different numbers of pump stages are applied onto one another, depending on the required power of the pump assembly. There, the individual pump stages are preferably designed in an identical manner and are held together by way of suitable connectors, for example tightening straps.

Even if the individual pump stages are designed identically, certain components must be set with regard to their length to the total number of applied pump stages. There is, on the one hand, the shaft which drives the impellers of the pump stages and extends through the whole pump, and is coupled at one end to a motor shaft. On the other hand, there are the tightening straps, which hold the individual pump stages together, and optionally a cable guide which is arranged on the outer side of the pump assembly, in order to lead the connection cable from the drive motor, which is arranged at the lower end of the pump assembly, to the upper end. These components must therefore be manufactured and made available in different lengths, in order to be able to construct pump assemblies with different numbers of pump stages.

BRIEF SUMMARY OF THE INVENTION

With regard to this background, it is an object of the invention to improve the construction of such pump assemblies to the extent that pump assemblies with different numbers of pump stages may be constructed with a reduced number of individual parts which need to be specially adapted.

The pump assembly according to embodiments of the invention comprises a pump having one or more pump stages. There, according to an embodiment of the invention, one envisages different numbers of identical pump stages being able to be applied onto one another, in order to construct a pump assembly having a desired number of pump stages. The pump assembly according to embodiments of the invention therefore has a modular construction. The individual pump stages are coupled to a drive motor.

According to embodiments of the invention, a special construction of individual components of the pump assembly is provided, in order to reduce the number of required individual parts, which are necessary for such a modular construction for realizing pumps with different numbers of pump stages. With regard to these, it is the case of length-dependent components, whose length depends on the number of applied pump stages, i.e., in particular the shaft, possible clamping elements and/or a required cable guide, as the case may be. According to an embodiment of the invention, one envisages at least one of these components, whose axial length is dependent on the number of pump stages, on at least one of its axial ends being designed such that no connection configuration, which is designed in the component itself and is limited to the axial end, is provided at this axial end. This means that the components should be designed such that at least one axial end does not need to have a special geometric design, which permits this axial end to be connected or coupled to other components. It is thereby possible to cut this component to length from a longer component into the desired length. Thus for example, if a shorter shaft is required, this may be sawn off from a longer shaft or from a longer rod material. In a corresponding manner, a clamping element may be shortened accordingly, depending on the requirements. These components do not have positive fit elements at the axial end for coupling to a motor shaft, as for example with a conventional shaft, or hooks for hooking into adjacent pump parts as with a conventional clamping element. Instead of such a special connection configuration at the axial end of the component itself, according to an embodiment of the invention, one envisages connecting the axial end to the additional connection element. Thereby, this connection should be effected with a friction fit and/or with a positive fit, wherein preferably no additional special connection elements or connection techniques are to be applied. The connection element in turn is coupled and/or connected to adjacent parts of the pump assembly or envisaged for coupling to adjacent parts of the pump assembly. This means that the connection element comprises the special connection configuration, for example in the form of a coupling, for connection to a motor shaft.

The suggested construction of the length-dependent components according to embodiments of the invention has the advantage that a pump assembly with a certain number of pump stages may not only be industrially manufactured, but for example may also be assembled into the desired configuration by a dealer on location. Thereby, one does not require a costly storage, which keeps the length-dependent components in all possibly required lengths. Rather, these elements may be made available in a maximum length or, as the case may be, as an "endless material," from which then the required length may be cut, for example cut off or sawn off. The length results from the number of pump stages. The cut-to-length component, with an axial end or with both axial ends, is then connected with a friction fit and/or positive fit to suitable connection elements, in order to then be able to create a connection to the adjacent pump parts by the connection elements. The connection to the connection elements requires no special design of the axial ends of the length-dependent components themselves, so that one may make do without any expensive machining of these ends, for example the incorporation of a groove for a fit key or the like.

With regard to the components or the length-dependent component, according to a first embodiment, it is the case of a clamping element, preferably a tightening strap which holds the pump of the pump assembly together in the axial direction. Such a clamping element or tightening strap extends over the length of the pump, i.e., along the outer side of the pump stages which are applied over one another or onto one another, from the first to the last pump stage, and there is connected to adjacent components of the pump. These adjacent components are the end sections of the pump, for example the pressure union at the exit end, and a connection element at the opposite end, which comprises the suction ports of the pump and is provided for connection to a drive motor. Such a clamping element may, for example, be designed as a long threaded rod, which may be easily cut into the required length. Thereby, such a threaded rod indeed does not have a connection configuration limited to the axial end, but rather the thread preferably extends over the entire length or, however, at least over a length of the threaded rod, which goes beyond the end region. The connection elements may then be screwed on the axial ends.

The design of the clamping element as a tightening strap is particularly preferred, for example as a sheet-metal strip of rust-free stainless steel. Such a material may be provided in a large length, for example rolled up, and then cut off to the desired length, depending on the number of pump stages to be held together. These tightening straps then do not comprise firmly formed hooks or threaded sections for connection to adjacent pump parts, at their axial ends, as with the conventional configuration, but there are connected to a connection element which comprises a special geometric configuration for connection to adjacent pump parts.

Preferably, the clamping element on at least one axial end is connected with a positive fit to a connection element which has a connector, in particular a hook and/or a thread, which fixes the clamping element on the pump. The clamping element is thereby designed such that it indeed does not have a special connection configuration at the axial end. Rather, it may be cut to length to a desired amount from a longer component, without the resulting axial end having to be specially machined, in order to give it a connection configuration. Rather, this axial end is then connected with a friction and/or positive fit to the connection element which has this connection configuration. This connection configuration may be designed in the known manner as a hook or thread, in order to then fasten the tightening strap to the pump.

According to a special embodiment, the clamping element on at least one axial end is connected with a positive fit to a connection element, wherein the connection element is integrated into the pump. This means that at least one of the connection elements may be an integral constituent of a further component of the pump, for example of a connection piece between the pump stages and a drive motor. Thus, the number of the required components may be reduced, since one may make do without a separate connection element at least at one axial end of the clamping element. Simultaneously, no special connection geometry needs to be designed on the tightening strap at this end. Instead of this, a receiver is formed on a component of the pump, for example on the connection piece, in which receiver the tightening strap may be fixed with a positive fit. The receiver thereby corresponds to the receiver, as is also formed in a separate connection element for the positive-fit connection.

Preferably, the clamping element is provided with an arrangement of engagement elements, which is repeated over the length, the engagement elements being engaged or able to engage with corresponding engagement elements on the connection element. The engagement elements are thereby repeated, preferably in certain intervals, which correspond to the length of a pump stage. Thus, it is ensured that if the clamping element is cut into a length which corresponds to a certain number of pump stages, exactly one fitting engagement element is situated at the axial end, and this engagement element may engage with a corresponding engagement element on the connection element. Such engagement elements may for example be holes or projections, which are arranged in the clamping element distributed over the length of the clamping element in a repeating manner over defined distances. Corresponding recesses or projections may be formed on the connection element, which may engage with these holes or projections on the clamping element.

Particularly preferably, the engagement elements are formed on the clamping element in the form of changes of the width of the clamping element, which are repeated in the axial direction. This means that the clamping element on its outer contour has a corrugated or zigzag shape, so that undercuts or shoulders are formed in the longitudinal direction of the clamping element, behind which engagement elements on the connection element may engage. Particularly preferably, the clamping element is thereby designed as a flat tightening strap, whose side edges are contoured in a corrugated or zigzag-like manner. One or more toothed side edge(s) would alternatively be conceivable, or the design of individual, regularly spaced recesses or projections on one side edge or both side edges.

The connection element in a corresponding manner preferably comprises a receiver for the clamping element, which in its width tapers to one axial end, in a manner such that it engages behind the clamping element in a region with a reduced width. This means that the receiver for the clamping element, in the connection element, has a smaller axial width at the end which faces the clamping element. Preferably, this is an axial width, which corresponds to the width of the clamping element at is narrowest location. Proceeding from this tapering of the width at the axial end, the receiver widens preferably in the axial direction distant from the clamping element, so that there one may receive a region of the clamping element with a greater width. Thus, the receiver of the connection element embraces the region of the clamping element which is widened in width.

According to a second preferred embodiment of the invention, the component, i.e. the length-dependent component, is a shaft of a pump which drives the impeller or impellers, wherein the shaft at a longitudinal end is provided with a coupling with a friction fit, which forms a connection element. The friction-fit connection to the coupling has the advantage that no positive fit elements at the axial end need to be formed in the shaft itself. The friction-fit connection may be effected on a smooth shaft, such that this may be cut to length from the rod material or tube material, into the desired length. The coupling preferably serves for connection to the axial end of a motor shaft of the motor applied onto the pump, wherein the motor and the pump form the pump assembly according to the invention.

Preferably, the coupling at an axial side comprises a friction fit element and on an opposite axial side comprises a positive fit element. The friction fit element serves for the friction fit connection to the pump shaft, as previously described. The positive-fit element serves for connection to the axial end of the motor shaft. The positive fit element may, for example, be formed as an inner toothing in a receiver opening at the axial end of the coupling, into which a toothed end of the motor shaft engages, so that a positive fit connection between the motor shaft and the coupling is created for torque transmission.

The shaft preferably has a constant cross section over its length. It is thus possible to cut the shaft to length in an infinite manner from a rod material, depending on the number of envisaged pump stages. A special geometric design of the axial end, as previously described, is not necessary.

Further preferably, the impellers of the pump are also fixed in a rotationally fixed manner to the shaft with a friction fit. Thus, no machining steps on the shaft itself are necessary for fastening the impellers. Rather, the impellers may be clamped at the desired location onto the shaft, which has a constant cross section preferably over the whole length.

For this, the impellers preferably have a hub with a conical inner periphery, and a clamping cone with a corresponding conical outer periphery, wherein the clamping cone is slotted, comprises an axial through-hole, through which the shaft extends, and is clamped by a clamping element against the conical periphery of the hub. The clamping element may, for example, be a screw, which is engaged with a thread on the outer periphery of the clamping cone. Thereby, the screw or nut preferably engages on the axial end of the clamping cone, which has the smallest diameter. The arrangement thereby is such that this end extends preferably beyond the axial end of the hub, so that the screw may be supported against the axial end of the hub. The clamping cone may then be tightened further into the inside of the hub by way of rotating the screw, wherein the clamping cone is reduced in its diameter, in that the width of the slot is reduced, on account of the conical design of the inner diameter of the hub, and of the conical outer periphery of the clamping cone. The clamping cone and with it, the hub, and thus also the impeller, are clamped onto the shaft in this manner.

The friction fit element of the coupling is also preferably designed in a manner such that the coupling at one axial end comprises a receiver with a conical inner periphery, as well as a clamping cone with a corresponding conical outer periphery, wherein the clamping cone is slotted, comprises an axial through-hole, through which the shaft extends and is clamped by a clamping element against the conical inner periphery of the receiver. This clamping element, as previously described by way of the clamping connection for the impeller, may likewise be a clamping screw. The fastening on the shaft thereby corresponds to the previous description, wherein the function of the hub is assumed by the coupling. The clamping screw instead of engaging on the clamping cone itself, may engage on a thread on the coupling, which is preferably arranged at the axial end of a conical opening accommodating the clamping cone. Then, the clamping cone may be pressed into this conical opening by way of the clamping screw, which may be designed, e.g., as a union nut. Thereby, the clamping cone is reduced in diameter, wherein the slot is reduced in its width. The clamping cone is firmly clamped with the surrounding coupling onto the shaft in this manner.

According to a third preferred embodiment, the component, i.e. the length-dependent component, is a cable rail extending in the axial direction. Such a cable rail is arranged along the length of the pump, in order to lead the electric connection cable for the drive motor from one axial end of the pump to the opposite axial end of the pump. This is particularly required when the pump is designed as a submersible pump, wherein the motor is arranged on the lower side of the pump, while the cable must be led to the top of the bore hole. The length of such a cable rail is also dependent on the length of the pump, which in turn depends on the number of applied pump stages.

Preferably, the cable rail has a constant cross section over its entire axial length and engages on at least one axial end into a connection element, which fixes the cable rail on the outer periphery of the pump. Thereby, the cable rail is preferably connected to the connection element with a positive fit. The connection element in this case comprises fastening elements for attachment on the pump, for example holes, through which screws may be led, in order to screw the connection element to the pump. The positive-fit connection of the cable rail to the connection elements is preferably effected in a manner such that a connection element is arranged at each end of the cable rail, wherein each connection element comprises a bearing surface, which comes into contact with an end-face of the connection rail. Thus, the cable rail is limited in its axial movement, i.e. in the axial direction, by the two connection elements. Moreover, the connection element is preferably designed in a manner such that it encompasses the cable rail in the region of the axial end on the outer side, so that the cable rail is also held in the connection element in a transverse direction, i.e. transverse to its longitudinal axis. The cable rail in the second transverse direction normal to the longitudinal axis may be fixed by the connection element in a manner such that the cable rail is fixed between the connection element and the outer periphery of the pump on fastening the connection element.

If the cable rail has a constant cross section over its length, it is possible to cut off or saw off the cable rail from a long component with the cross section of the cable rail, into the desired length. The long component is preferably a long profile in the form of a cable rail, from which the cables rail is cut off.

It is to be understood that the length-dependent component may not just be either a clamping element, a shaft or a cable rail, but instead, with regard to the pump assembly according to the invention, two, preferably all three components, i.e. shaft, clamping element and cable rail may be designed in the previously described manner. Although, as previously described, it has been friction fit connections and/or positive fit connections which have been discussed, it is to be understood that, optionally, these connections may additionally be bonded. Bonding is a connection method which may not only be applied on an industrial scale, but may also be carried out on location on assembly of the pump assembly.

The subject matter of the invention further comprises a method for the modular construction of a pump assembly with a single-stage or multi-stage pump. Here, the pump assembly preferably corresponds to the preceding description.

The subject-matter of the invention is such that at least one of those components of the pump assembly, whose length is dependent on the number of pump stages, i.e., on the length of the pump, is not manufactured specially with regard to its length for a certain number of pump stages. Instead, this length-dependent component is cut to the desired length before assembly of the pump, depending on the desired number of pump stages at the time. This permits pumps with the desired number of pump stages to be assembled in accordance with requirements, without having to store special, length-dependent components for each realizable number of pump stages. Instead of this, it is sufficient to store the longest version of the respective component which could occur, and to shorten this component as the case may be, should fewer pump stages be used. Alternatively, the components could also be provided as a long material. Thus for example, a tightening strap may, for example, be supplied as a sheet metal strip from a roll.

For assembly, the component is cut to length or cut off from a universal component, into the desired length. Subsequently, it is connected at its axial end to a connection element, which in turn comprises a special connection configuration, which serves for connection or coupling to adjacent parts of the pump assembly. The connection of the axial end of the length-dependent component to the connection element is preferably effected with a friction and/or positive fit. The above description of the pump assembly is referred to with regard to the details of the method, and the details of the course of the method are to be deduced from this.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
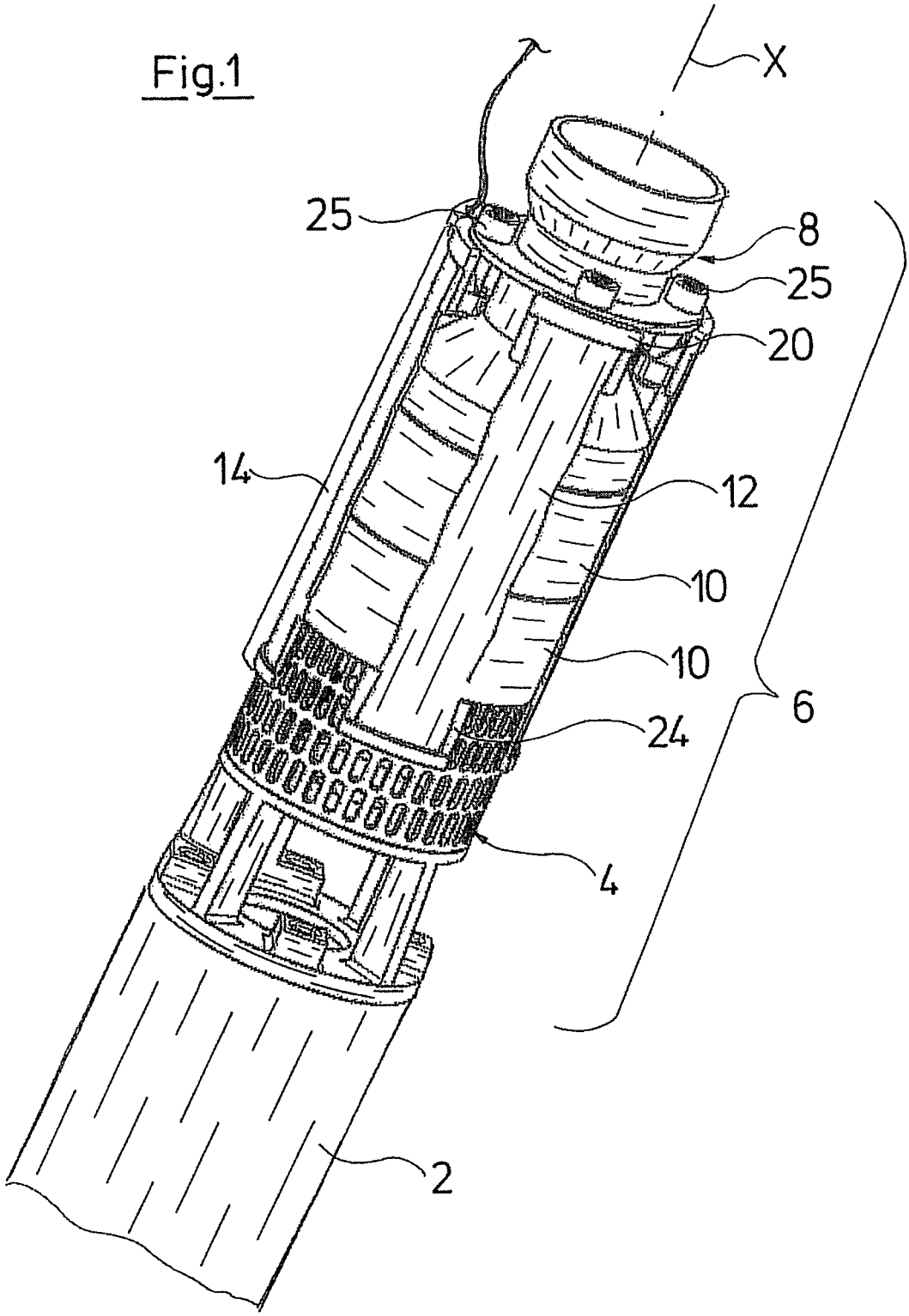
FIG. 1 is an overall, perspective view of a pump assembly according to an embodiment of the invention.

The pump assembly shown in FIG. 1, is designed as a submersible pump assembly, and at an axial end, which is at the bottom in use, comprises a drive motor 2 to which an intermediate piece 4 is axially attached, which serves for connecting the pump 6 to the drive motor 2. The pump 6 at the axial end opposite to the connection piece 4 comprises a connection piece 8, in which the pressure union of the pump is formed. A multitude of pump stages 10 is arranged between the intermediate piece 4 and the connection piece 8. Clamping elements in the form of tightening straps 12 are provided for holding the pump 6 together, and these tightening straps with their one axial end are fixed on the intermediate piece 4 and with the opposite axial end are fixed on the connection piece 8 and brace both to one another, so that the individual pump stages 10 are pressed on one another and are held clamped between the connection piece 8 and the intermediate piece 4. Moreover, a cable guide 14, in which the connection cable is led from the drive motor 2 to the opposite axial end of the pump assembly, extends on the outer periphery of the pump 6 in the axial direction beyond this.

Different numbers of pump stages 10 are applied onto one another depending on the required power or delivery head of the pump assembly. In order to permit this, different length shafts, via which the impellers of the individual pump stages 10 are driven, are necessary in the inside, as well as different length tightening straps and different length cable guides 14 on the outside.

According to the invention, a modular system is now provided, according to which these three mentioned length-dependent components, shaft, tightening straps 12 and cable guide 14, do not need to be stored in different lengths for different numbers of pump stages 10, but may be individually manufactured or prepared in the desired length in a simple manner before the assembly of the pump assembly. Thus, for each of these three mentioned components, it is possible to store in each case only one universal component, from which then the desired length may be cut off or shortened for the respective pump to be assembled.

Figure 2:
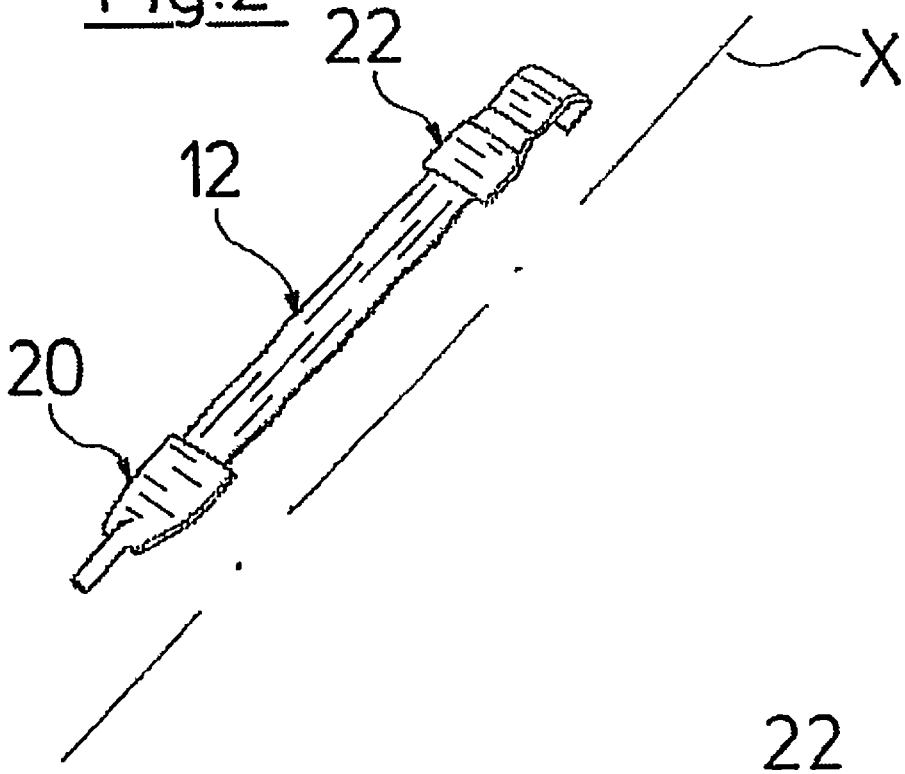
FIG. 2 is a perspective view of a tightening strap of the pump assembly according to FIG. 1.
Figure 3:
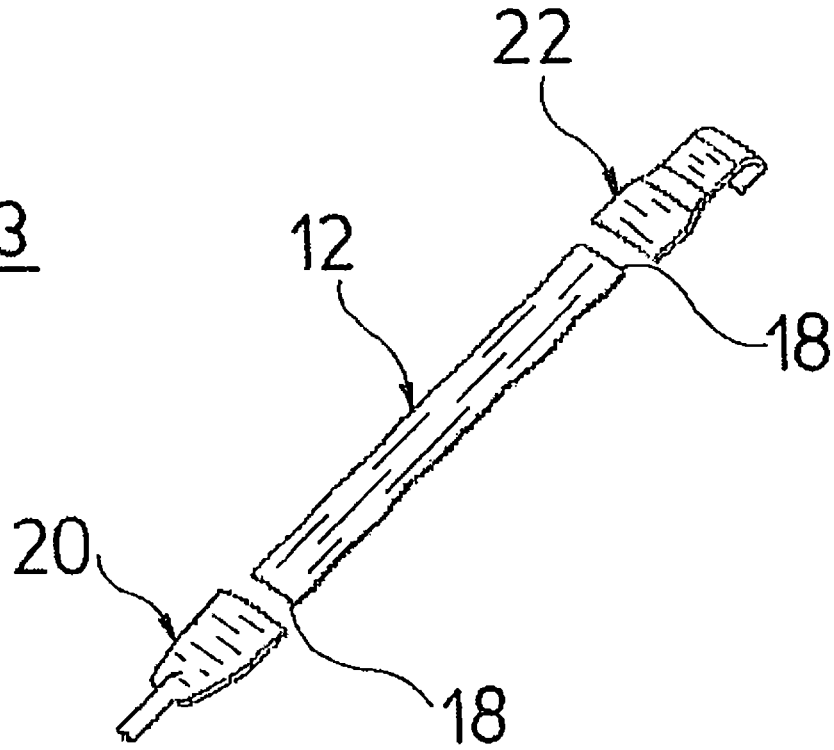
FIG. 3 is an exploded view of the tightening strap according to FIG. 2.
Figure 4:
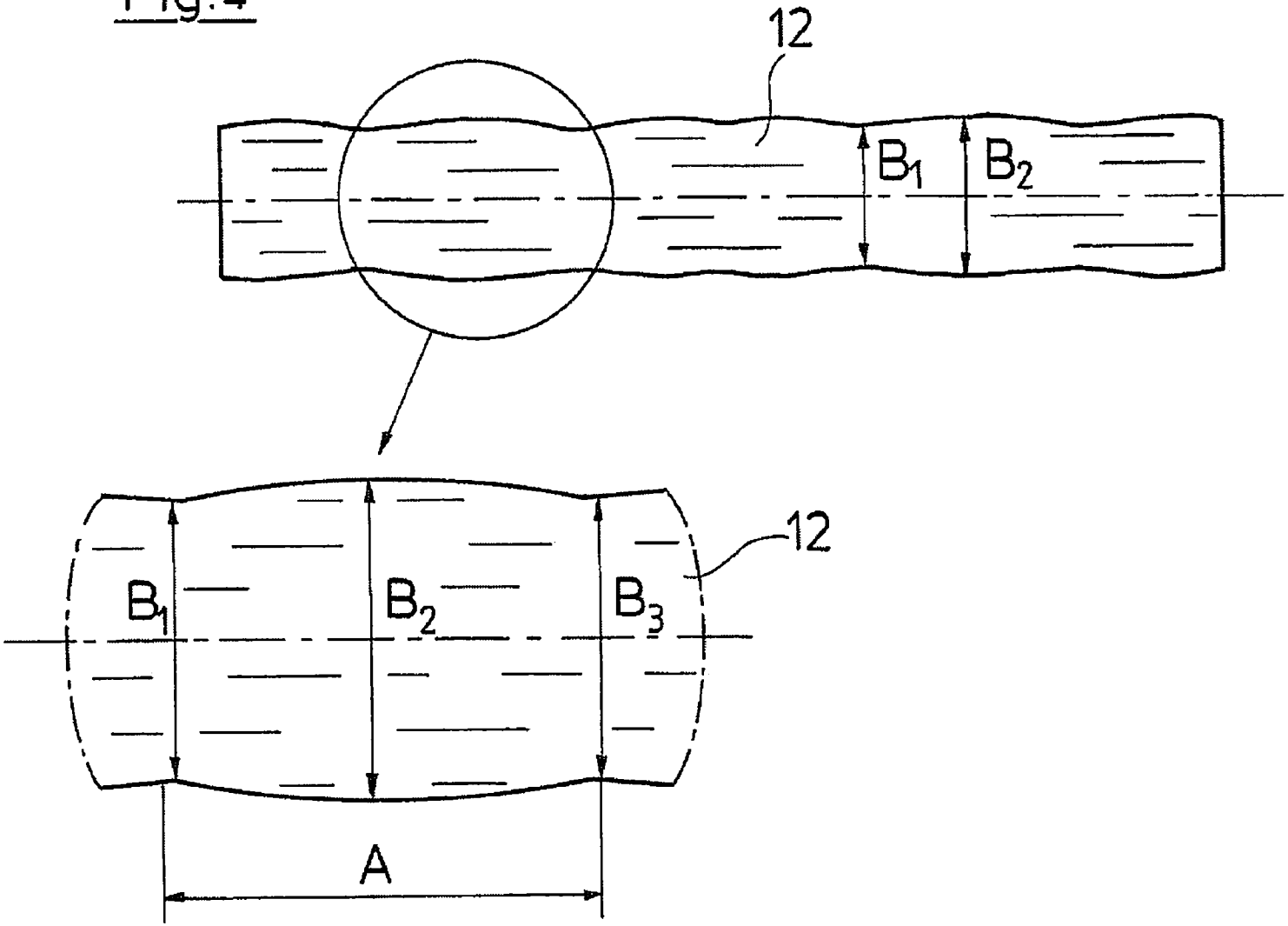
FIG. 4 is a plan view of the tightening strap according to FIGS. 2 and 3, without connection elements.

The design of the tightening straps is first explained by way of FIGS. 2 to 4. The actual tightening strap 12 is designed as a simple strip element of sheet metal and has no special end configuration. This means that at the axial ends 18, no connection configurations are formed on the tightening strap itself for fastening on the connection piece 8 or on the intermediate piece 4. This connection configuration is rather rearranged into two connection elements 20 and 22, which are connected to the axial ends 18 of the tightening strap 12. The connection element 20 comprises a threaded rod, with which it may be screwed onto the connection piece 8. The connection element 22 comprises a hook, with which it may engage into a recess on an intermediate piece 4. The tightening strap 12 may then be tensioned on the pump 6 via a nut on the thread of the connection element 20.

Here, it is to be understood, however, that the tightening by way of a screw may also alternatively be effected on the intermediate piece 4. Then, the clamping element may be suitably fixed directly on the connection piece 8.

Figures 14, 15:
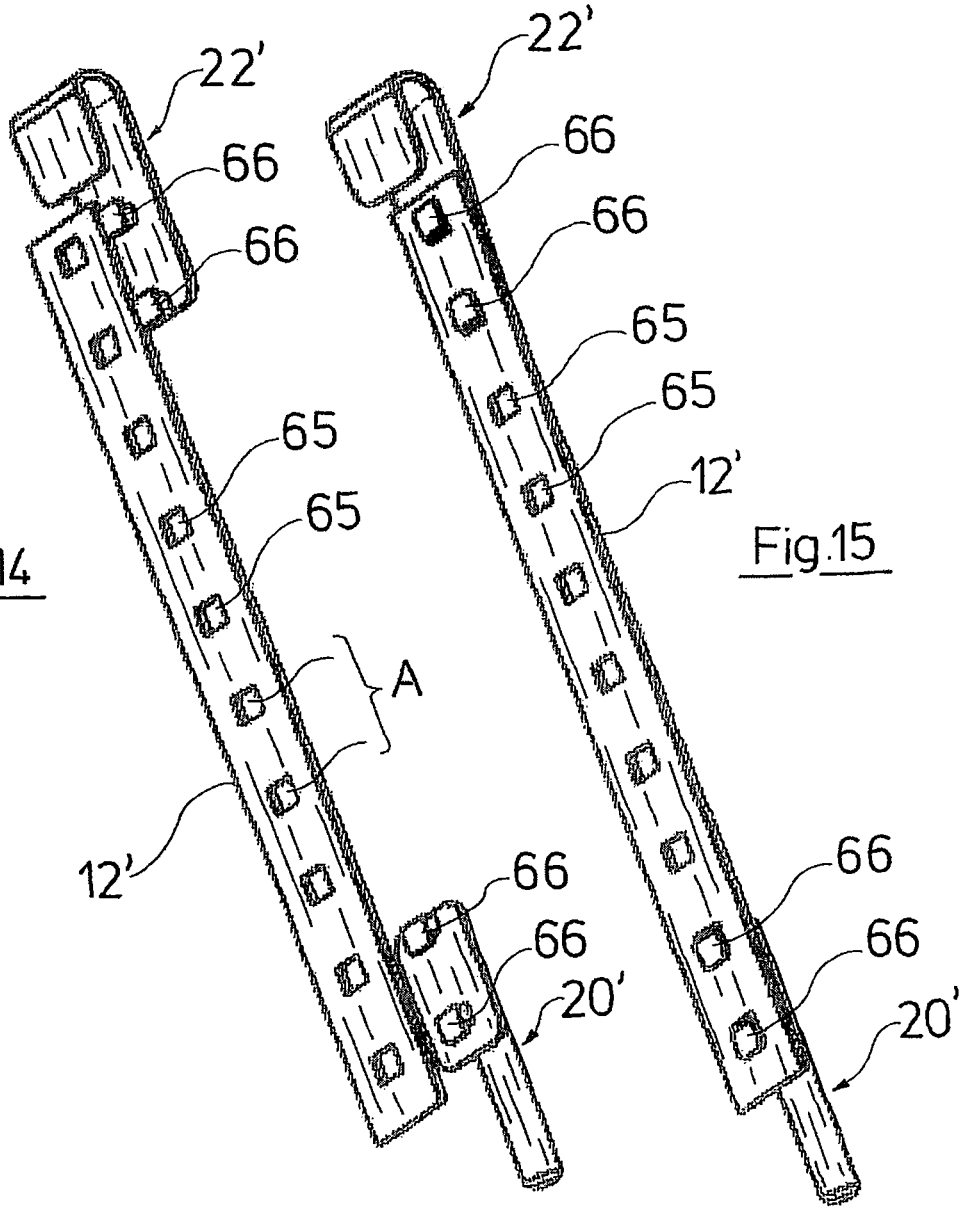
FIG. 14 is an alternative embodiment of the tightening strap with connection elements, in a perspective exploded representation.
FIG. 15 is a perspective view of the components according to FIG. 14, in the joined together form.

An alternative design of the tightening strap 12' and connection elements 20' and 22' is represented by way of FIGS. 14 and 15. There, the tightening strap 12' is likewise formed as a sheet metal strip consisting of stainless steel, which may be cut to length depending on the required length. The sheet metal strip comprises a multitude of rectangular recesses 65, which are arranged in each case at the same spacing A to one another in the longitudinal direction of the strip. The spacing A of two recesses 65 corresponds to the axial length of a pump stage 10. Hook-like elements in the form of a shape-out 66 are provided on the connection elements 20' and 22', which otherwise, with regard to their function and arrangement, correspond to the connection elements 20 and 22. These hook-like elements are for the positive-fit connection to the tightening strap 12' and are envisaged for engagement into the tightening strap 12' and in the joined condition (FIG. 15) pass through and engage behind the recesses 65. In the assembled condition of the pump, thus when tensile forces act on the connection pieces 20' and 22', which brace the pump stages 12', these shape-outs connect to the tightening strap 12' with a positive fit. The hook-like elements 66 are thus in each case designed in an open manner in the direction in which the tensile forces are exerted, and are designed closed in the opposite direction.

Figure 12:
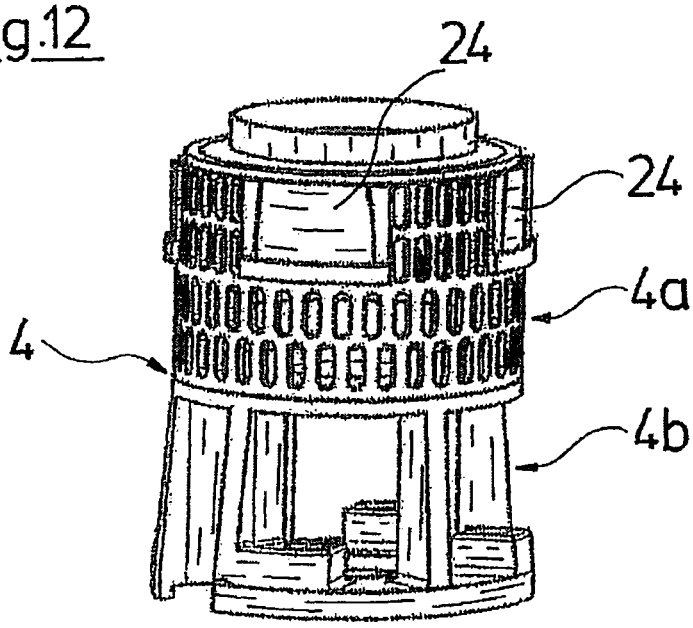
FIG. 12 is a detailed lateral, perspective view of the intermediate piece shown in FIG. 1.
Figure 13:
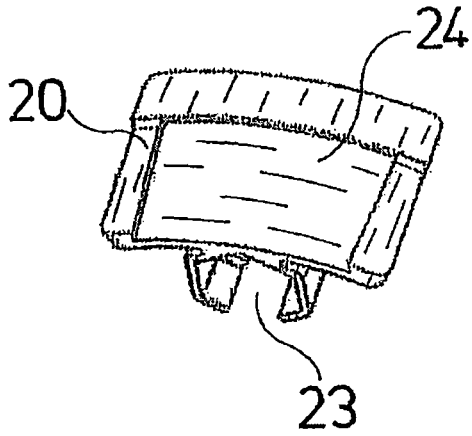
FIG. 13 is a perspective view of an alternative embodiment of a connection element.

FIGS. 12 and 13 moreover show alternative designs of connection elements 20 and 22. Thus, according to FIG. 12, as also shown in FIG. 1, the connection element 20 may be integrated into the connection piece or intermediate piece 22 directly in the form of a receiver 24. Thereby, the receiver 24 is designed according to the subsequent description. The receiver 24 permits the tightening strap 12 to be fixed directly with a positive fit on the intermediate piece 4, without having to have a special connection configuration provided at the end. The intermediate piece 4 is thereby preferably assembled in a two-part manner from two parts 4*a* and 4*b*. Preferably, the part 4*a* of the intermediate piece 4 is manufactured as a metal powder injection molded part. This, in particular, permits the complex geometry of the receiver 24 to also be formed directly in the intermediate piece 4 in a very simple manner. The part 4*b* of the intermediate piece is preferably designed as a conventional metal cast part. Both parts 4*a* and 4*b* are then welded to one another. However, it is also conceivable to design the intermediate piece 4 as a single part component, for example as a cast part.

Instead of providing the connection piece 20 with a screw, as has been described previously and is shown in FIGS. 2 and 3, it is also possible to provide a receiver 23 for a conventional hexagonal nut in the connection piece 20, as is shown in FIG. 13. Thus a hexagonal nut may be inserted into the recess 23, into which nut a screw 25 may then be rotated in order to tighten the connection element 20 in the manner described above. This is also shown in FIG. 1. The connection element 20 shown in FIG. 13 may also preferably be manufactured as a metal powder injection molded part. Thereby, the complex geometry of the receiver 24 is easy to accomplish. With the configuration according to FIGS. 12 and 13, the receivers 24 are designed on the outer side of the pump, i.e., are open to the outside. Otherwise, the design of the receiver 24 corresponds to the design of the receiver which is described hereinafter by way of FIGS. 5 and 6, only that in FIGS. 5 and 6, the receivers 24 on the connection elements 20, 22 face the inner side in the radial direction, which may also be recognized in FIGS. 2 and 4.

The tightening strap 12 is designed as a curved sheet metal strip. The curvature is adapted to the curvature of the outer periphery of the pump 6. The sheet metal strip has a change in width which is repeated over the length. This means that sections with a smaller width B1 and sections with a larger width B2 are repeated. The repetition section A thereby corresponds to the length of a module, i.e., the length of a pump stage 10. Due to the repeating width change of the tightening strap 12, this has the shape of trapezoidal sections connecting to one another, i.e., proceeding from a region of a small width, the width of the tightening strap widens to the width B2 and proceeding from there, the width reduces again to the width B1, etc. Thus a zigzag-like contour of the tightening strap 12 arises. This contour forms engagement elements which are repeated at a spacing A over the length of the tightening strap 12. The tightening strap 12 may be fastened with a positive fit to the connection elements 20 and 22 by way of these engagement elements. Depending on the length of the pump 6, i.e., the number of pump stages 10, the tightening strap 12 may be cut into a suitable length with a multiple of the repetition spacing A. There, the tightening strap is cut to length such that it ends at the axial ends 18 in the region of its greater width B2. Thus, proceeding from the axial ends 18, the width of the tightening strap reduces, so that regions of a small width B1, i.e. neckings in the width, are given at a distance to the axial ends 18. Thus, one may engage behind the axial ends 18 in the width with a positive fit, as will be explained in more detail by way of the FIGS. 5 and 6.

Figure 5:
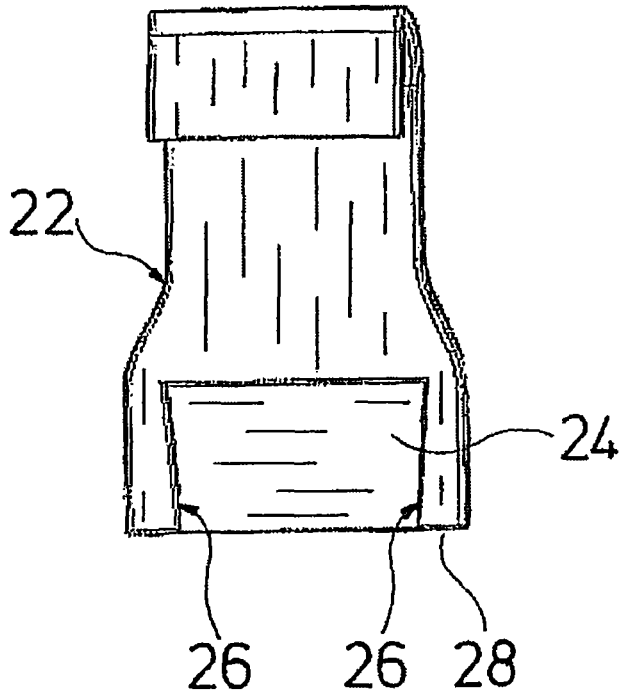
FIG. 5 is a lateral view of the connection element in FIGS. 2 and 3.
Figure 6:
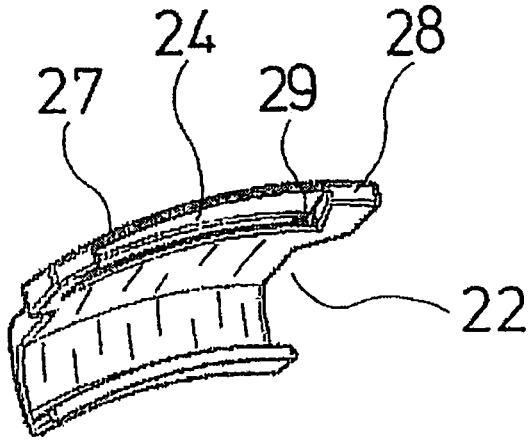
FIG. 6 is an axial plan view of the connection element according to FIG. 5.

The connection of the connection element 22 to the tightening strap 12 is described in more detail by way of the FIGS. 5 and 6. There, it is to be understood that the connection of the connection element 20 at the opposite end of the tightening strap 12 is effected in the same manner. The connection elements 20 and 22 differ only by the fact that the connection element 22 comprises a hook for connection to the pump, and the connection element 20 comprises a threaded pin.

A receiver 24 is formed on the connection element 22 (accordingly also in the connection element 20), and this receiver comprises two side edges 26 which run obliquely to one another, so that as a whole a trapezoidal or conical receiver 24 is created, which has its smallest width at the axial end 28 of the connection element 22. The receiver 24 is open to the inner side, i.e., to the side which faces the pump stages 10, and at the outer side it has a closed outer wall 27.

The designs shown in FIGS. 1, 12 and 13 are designed in the precisely reverse manner. There, the receiver 24 is designed open to the outside and the inner side is designed in a closed manner.

Moreover, the receiver 24 comprises a groove 29 in the side walls 26 and in the base edge which connects the side walls 26, i.e., the edge distant to the axial end 28. The receiver 24 is designed such that the axial end 18 of the tightening strap 12 may be inserted into this, such that the region of the tightening strap with the smallest width B1 comes to lie in the region of the axial end 28 between the side edges 26 of the receiver 24. The region of the larger width of the tightening strap B2 lies at a distance to the axial end 28 in the receiver 24. The smallest distance between the side edges 26 is thereby smaller than the largest width B2 of the tightening strap 12. Thus, the side edges 26 may engage behind or around the axial end of the tightening strap 12. A fixation in the axial direction is achieved in this manner. Moreover, the peripheral groove 29 ensures that the connection element 22 in the tensioned condition may not slip away from the tightening strap 12 in the radial direction with respect to the longitudinal axis X of the pump. The tightening strap 12 engages with its side edge into the groove 29. For this, the groove has a width which is slightly larger than the material width of the tightening strap 12. Thus a secure positive fit connection between the connection element 22 and the tightening strap 12 is created in all directions.

Figure 7:
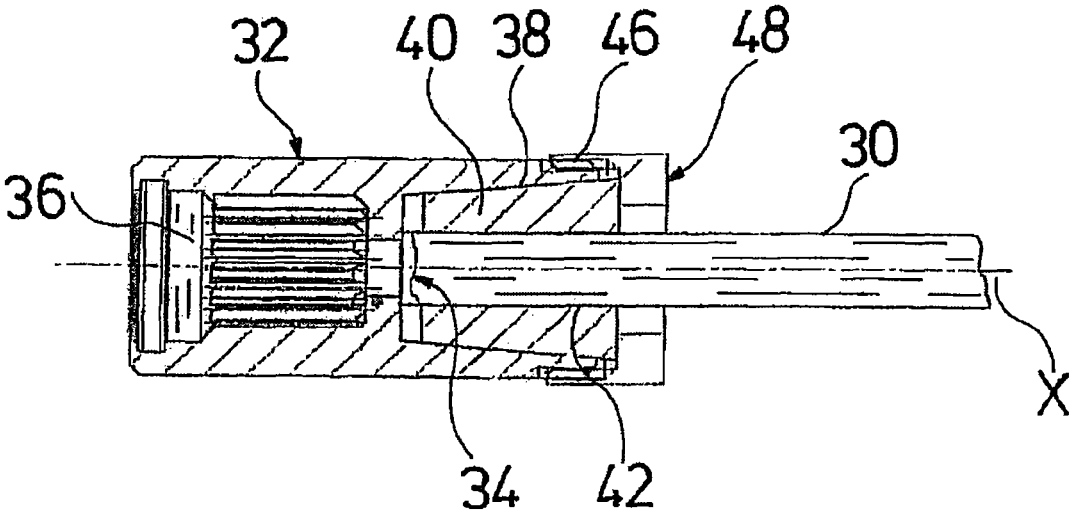
FIG. 7 is a sectional view of a coupling according to an embodiment.
Figure 8:
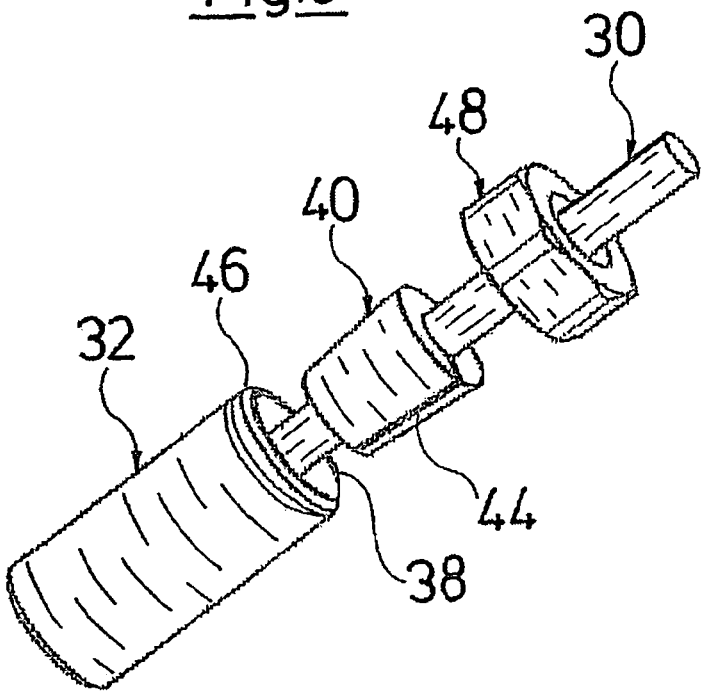
FIG. 8 is a perspective, exploded view of the coupling of FIG. 7.

The design of the shaft 30 and its connection to a coupling 32 is described in more detail by way of the FIGS. 7 and 8. The shaft 30 is designed as a simple round rod, and at its axial end 34 has no special geometric connection configuration for the positive-fit connection to the coupling 32. Thus, the shaft 30 may be cut to length or sawn off in a simple manner from a long material, and no further machining of the axial end 34, for example for incorporating a groove or the like, is necessary. Instead, the coupling 32 is merely fixed with a friction fit at the axial end 34 of the shaft 30. The coupling 32 thus forms a connection element for connection to further parts of the pump. In this case, this is a drive shaft of a drive motor which is not shown here.

The coupling 32 at an axial end comprises a receiver opening 36 with an inner toothing, into which a correspondingly toothed axial end of the drive shaft of the drive motor may engage, for the coupling to the driven shaft of the drive motor. The receiver opening 36 thus forms a positive-fit element at a first axial end of the coupling 32. The opposite axial end 34 is designed for a purely friction fit connection to the shaft 30.

For this, a conical receiver opening 38 is designed at this axial end. The conical receiver opening 38 comprises a conical inner contour and is situated concentrically to the shaft longitudinal axis X, as the receiver opening 36. The conical receiver opening 38 tapers toward the inside of the coupling 32. A clamping cone 40 is inserted into the conical receiver opening 38. The clamping cone 40 has a conical outer contour, which corresponds to the conical inner contour of the receiver opening 38, i.e., in particular both have the same gradient relative to the longitudinal axis X. The clamping cone 40 in its inside has a cylindrical through-hole 42, into which the shaft 30 is inserted. Moreover, the clamping cone 40 is designed in a slotted manner, i.e., it comprises a slot 44 which extends in the radial direction from the through-hole 42 to the outer periphery, and thus is open to the through-hole 42 as well as to the outer periphery. The slot 44, when the clamping cone 40 is pressed into the receiver opening 38, permits this clamping cone to be pressed together, so that the inner diameter of the through-hole 42 reduces, and the clamping cone 40 is pressed into the peripheral wall of the shaft 30 and creates a friction fit connection there.

At the same time, a friction-fit connection between the clamping cone 40 and the couplings 32 is created by way of the pressing between the clamping cone 40 and the inner wall of the conical receiver opening 38.

The coupling 32 at its axial end, to which the receiver opening 38 is open, is provided with a thread 46 at its outer periphery, in order to be able to press the clamping cone 40 into the receiver opening 38. A clamping screw in the form of a union nut 48 is in engagement with this thread 46, and this union nut with its inner side presses against the end-side of the clamping cone 40. Thus, the union nut 48, when it is screwed into the thread 46, presses the clamping cone 40 into the conical receiver opening 38, so that the conical outer surface of the clamping cone comes to bear on the conical inner surface of the receiver opening 38 and thus presses the clamping cone together.

Figure 9:
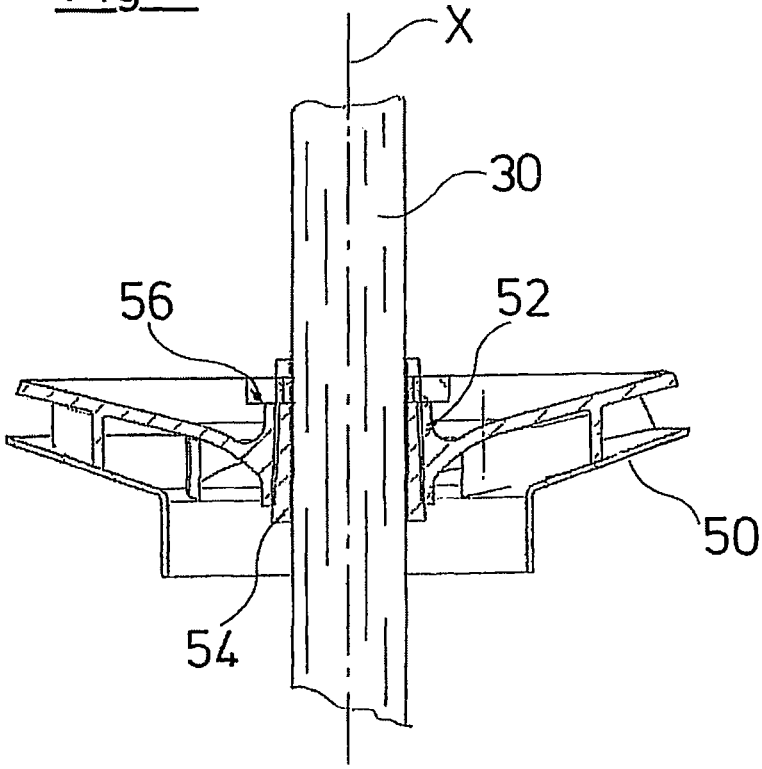
FIG. 9 is a partial sectional view of an impeller of the pump assembly according to FIG. 1.

As shown in FIG. 9, preferably the impellers 50 are also fastened on the shaft only with a friction fit 30. For this, the impellers 50 comprise a hub 52 with a conical inner periphery, into which a clamping cone 54 is inserted. The clamping cone 54 corresponds with regard to its design to the previously described clamping cone 40 of the coupling 32. In particular, the clamping cone 54 is likewise designed in a slotted manner. The clamping cone 54 at its tapered end comprises an outer thread, onto which a clamping screw or tightening nut 56 is screwed. The tightening nut 56 bears against the axial end of the hub 52 and thus, when it is screwed onto the clamping cone 54, pulls the clamping cone 54 into the inside of the hub 52. On account of the conical design, the inner diameter of the clamping cone 54 thereby reduces, so that the shaft 30 is clamped in the clamping cone 54 and simultaneously the clamping cone 54 is clamped in the hub 52 of the impeller 50. This purely friction-fit attachment of the impeller 50 on a smooth shaft 30 has the advantage that the shaft 30 may be manufactured in a simple manner of a round rod material or tube material, without positive-fit engagement elements having to be machined into the shaft at the locations, at which the coupling 32 or the impellers 50 are fastened. Inasmuch as this is concerned, it is possible to simply cut the shaft 30 to length from a long material in the desired length, which depends on the number of applied pump stages 10.

Figure 10:
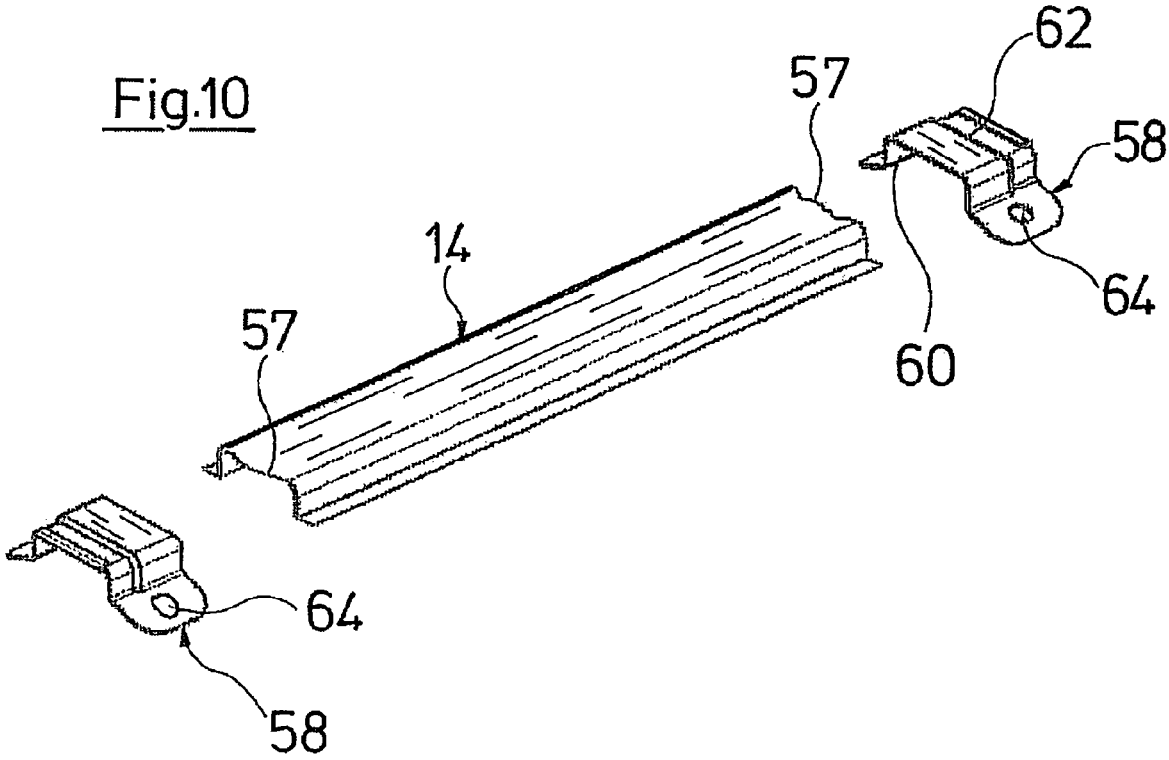
FIG. 10 is a perspective, exploded view of a cable guide of the pump assembly according to FIG. 1.
Figure 11:
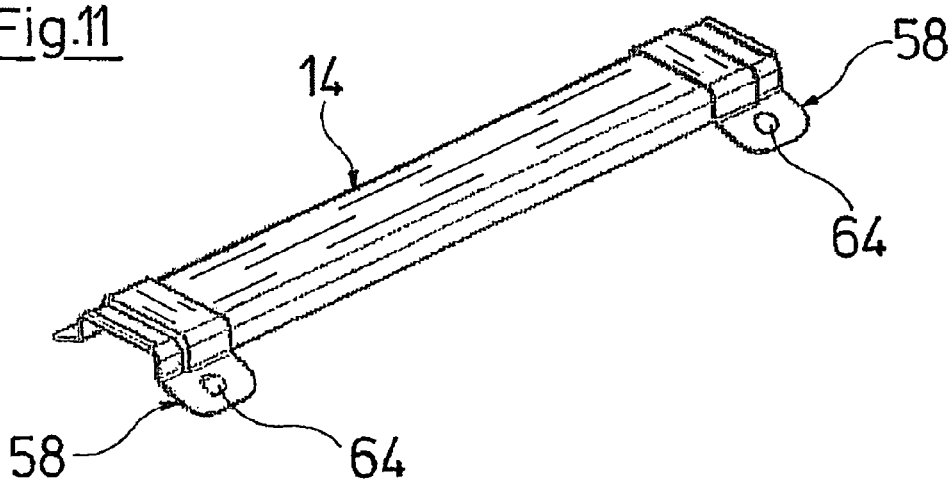
FIG. 11 is a perspective view of the cable guide according to FIG. 10, in the assembled condition.

Now, the third length-dependent component of the pump assembly, specifically the cable guide, is described by way of FIGS. 10 and 11. The cable guide 14 is designed as a sheet metal profile with an essentially U-shaped cross section. The cable guide 14 thereby has a constant cross section over the entire length. In particular, the axial ends 57 are not designed in any special manner. The axial ends 57 are inserted into connection elements in the form of end-pieces 58, which have a receiver 60 which is adapted to the outer contour of the cable guide 14. Thus, the cable guide 14 is held in the end-pieces 58 with a positive fit. In particular, each end-piece 58 at the rear end of the receiver 60, i.e., on the side which is distant to the other end piece 58, comprises a bearing shoulder 62, on which the end-edge 57 of the cable guide 14 comes to bear. Thus, the cable guide 14 may also be fixed in the axial direction between the two end-pieces 58.

The end-pieces 58 are preferably likewise manufactured of sheet metal, for example rust-free steel sheet, and comprise holes 54, into which screws may be inserted, in order to fasten the end-pieces 58 on the pump 6. In the shown example, both end pieces 58 are identical, but they may also be designed in a different manner.

Due to the fact that the cable guide 14 is likewise designed as a profile with a constant cross section without a special connection configuration at its axial ends 57, it is possible to cut off the cable guide 14 into the desired length from a long profile.

It is to be recognized that with this preferred embodiment, all length-dependent elements, specifically the tightening straps 12, the shaft 30 and the cable guide 14, are designed such that they have no special connection configuration at their axial ends, but are cut away to the desired length from a longer element. This renders it possible to manufacture very simple pumps with different numbers of pump stages 10, without special shafts 30, tightening straps 12 and/or cable guides 14 having to be stored for each possible number of pump stages. Instead, these length-dependent elements are cut to length into the desired length on assembly. After the cutting to length, it is not necessary to design certain connection configurations, e.g., in a material-removing manner, at the axial ends, or to weld these axial ends to connecting elements or to connect them in other expensive manners. Instead, purely friction-fit and/or positive-fit connections are provided, so that an assembly is possible within the framework of the technician. This renders it possible for such pumps to be able to be assembled in the desired length, i.e., with the desired number of pump stages 10, from the market, for example a dealer or wholesale dealer, in a very simple manner.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A pump assembly comprising:

a pump (6) having a number of pump stages (10) extending along a longitudinal axis (X) of the pump (6); and at least one component (12, 30, 14) having an axial length dependent upon the number of pump stages (10), the at least one component (12, 30, 14) having two axial ends (18), wherein no connection configuration is formed in the component (12, 14, 30) itself and is limited to the axial end, the at least one component (12, 30, 14) being connected at one or both of the axial ends with at least one of a friction fit and a positive fit to a connection element (20, 22, 32, 58) which is connected to adjacent parts of the pump assembly, or is provided for coupling to adjacent parts of the pump assembly, and wherein at least a portion of the connection element (20, 22, 32, 58) extends outwardly along the longitudinal axis (X) beyond at least one of the two axial ends (18) of the at least one component (12, 30, 14).

2. The pump assembly according to claim 1, wherein the component is a clamping element (12), which holds the pump (6) of the pump assembly together along the longitudinal axis (X).

3. The pump assembly according to claim 2, wherein the clamping element (12) is a tightening strap.

4. The pump assembly according to claim 2, wherein the clamping element (12) on at least one of the axial ends (18) is connected with a positive fit to the connection element (20, 22) comprising a connector that fixes the clamping element on the pump (6).

5. The pump assembly according to claim 4, wherein the connector comprises a hook or a thread.

6. The pump assembly according to claim 2, wherein the clamping element (12) on at least one of the axial ends (18) is connected with a positive fit to a connection element, which is integrated into the pump.

7. The pump assembly according to claim 2, wherein the clamping element (12) is provided with an arrangement of engagement elements repeated over a length thereof, the engagement elements being engaged or able to engage with corresponding engagement elements on the connection element (20, 22).

8. The pump assembly according to claim 7, wherein the engagement elements are present on the clamping element (12') in a form of preferably rectangular recesses (65) and the corresponding engagement elements on the connection elements (20', 22') are provided with hook-shaped elements (66) for positive fit engagement into the recesses (65), the recesses (65) being rectangular in shape.

9. The pump assembly according to claim 7, wherein the engagement elements are present on the clamping element (12) in a form of changes of width (B1, B2) of the clamping element (12), which are repeated along the longitudinal axis (X).

10. The pump assembly according to claim 8, wherein the connection element (20, 22) comprises a receiver (24) for the clamping element (12), which tapers in a width thereof to one axial end (28), in a manner such that the receiver (24) engages behind the clamping element (12) in a region with a reduced width (B1).

11. A method for modular construction of a pump assembly having a single-stage or multi-stage pump (6) that defines a longitudinal axis (X), wherein at least one component of the pump assembly, whose axial length depends on the number of pump stages (10), is not specially manufactured with regard to a length thereof for a certain number of pump stages (10), the method comprising cutting the component into a desired length for assembly, and on at least one axial end thereof connecting the component with at least one of a friction fit and a positive fit to a connection element (20, 22, 32, 58) which serves for connection or coupling to adjacent parts of the pump assembly, wherein no connection configuration is formed in the component itself and is limited to the axial end, and wherein at least a portion of the connection element (20, 22, 32, 58) extends outwardly along the longitudinal axis (X) beyond the at least one axial end of the component (12, 30, 14).

12. A pump assembly including a pump (6) comprising:

two or more pump stages (10) extending along a longitudinal axis (X);

at least one component (12, 30, 14) having an axial length dependent upon a number of the pump stages (10), the at least one component (12, 30, 14) having two spaced-apart axial ends (18); and at least one connection element (20, 22, 32, 58) surrounding substantially an entire one of the axial ends (18) of the at least one component (12, 30, 14), the at least one connection element (20, 22, 32, 58) including a threaded rod, at least a portion of the at least one connection element (20, 22, 32, 58) extending outwardly along the longitudinal axis (X) beyond at least one of the two axial ends (18) of the at least one component (12, 30, 14), the at least one connection element (20, 22, 32, 58) being removably attachable to one of the two spaced-apart axial ends (18) of the at least one component (12, 30, 14) and another portion of the pump (6) for holding the pump (6) together, wherein no connection configuration is formed in the component itself and is limited to the axial end.

* * * * *